US006000154A

United States Patent [19]

Berard et al.

[11] Patent Number: 6,000,154

[45] Date of Patent: Dec. 14, 1999

[54] QUICK CHANGE ATTACHMENT FOR POWERED AUXILIARY TOOL

[75] Inventors: Craig A. Berard, Oakes; Wally L. Kaczmarski, Lisbon, both of N. Dak.

[73] Assignee: Clark Equipment Company, Woodcliff Lake, N.J.

[21] Appl. No.: 09/028,794

[22] Filed: Feb. 24, 1998

Related U.S. Application Data

[63] Continuation-in-part of application No. 08/814,313, Mar. 10, 1997.

[51] Int. Cl.[6] ..... E02F 3/76

[52] U.S. Cl. ..... 37/468; 414/723; 414/912

[58] Field of Search ..... 172/272, 275; 37/468, 903; 414/723, 912

[56] References Cited

U.S. PATENT DOCUMENTS

| | | | |
|---|---|---|---|
| 5,024,010 | 6/1991 | Hulden | 37/468 |
| 5,415,235 | 5/1995 | Gebauer | 37/468 |
| 5,431,528 | 7/1995 | Jenkins et al. | 37/468 |
| 5,597,283 | 1/1997 | Jones | 37/468 |
| 5,692,325 | 12/1997 | Kuzutani | 37/468 |
| 5,727,342 | 3/1998 | Horton | 37/468 |

FOREIGN PATENT DOCUMENTS

| | | | |
|---|---|---|---|
| 1071151 | 2/1980 | Canada | 37/468 |
| 7904335 | 12/1980 | Netherlands | 37/468 |
| 763531 | 9/1980 | U.S.S.R. | 37/468 |
| 2169582 | 7/1986 | United Kingdom | 37/468 |
| 8802421 | 4/1988 | WIPO | 37/468 |

*Primary Examiner*—Christopher J. Novosad
*Attorney, Agent, or Firm*—Westman, Champlin & Kelly, P.A.

[57] ABSTRACT

A quick attach accessory tool mounting frame is adapted to be mounted onto a quick attachment bracket and held in place. The adapter frame has plates mounting a hub to pivotally mount a powered auxiliary tool. The hanger is formed with spaced plates having upper edges that will abut against portions of the adapter frame to permit only limited pivotal movement of a tool supported by the hanger about a horizontal axis such that the operator can control the position of the auger after the hanger has pivoted against provided stops that limit the pivotal movement of the tool about one axis.

13 Claims, 6 Drawing Sheets

QUICK CHANGE ATTACHMENT FOR POWERED AUXILIARY TOOL

CROSS REFERENCE TO RELATED APPLICATION

This application is a continuation-in-part of copending application Ser. No. 08/814,313, filed Mar. 10, 1997 for ATTACHMENT CONSTRUCTION FOR EARTHWORKING IMPLEMENT.

BACKGROUND OF THE INVENTION

The present invention relates to a mounting for a power driven auxiliary tool such as an earth auger that will permit quick attachment to an arm, such as a backhoe or excavator arm, using an adapter bracket that permits limited free pivotal movement of the accessory tool about an axis during operation.

The use of earth augers or other powered auxiliary tools, such as a plate compactor, mounted on a skid steer loader backhoe or an excavator arm is known. It is generally desirable to have some free pivotal movement for the power tool about a horizontal axis, as explained in U.S. Pat. No. 5,556,217. Patent '217 discloses an auger mount using a slot to permit some pivotal movement so that the auger can come to a vertical position under gravity and also move as it bores into the ground. It is desirable to have control over the pivotal position of the auger, after limited pivoting has occurred.

The support shown in U.S. Pat. No. 5,556,217 is pinned in place, which requires changing of pivot pins if a different attachment is to be coupled to the backhoe or excavator arm. With the advance of reliable, positive locking quick attachment brackets, it has become desirable to use a quick attachment arrangement for earth augers, compactors, clam shells and other powered implements as well.

SUMMARY OF THE INVENTION

The present invention relates to a mounting device for a powered auxiliary tool used with a boom or arm of a backhoe or excavator, which permits the power unit such as a motor to be mounted onto a quick attachment bracket usable with a frame that permits quick attachment to a boom or arm and which are also used with attachments for other types of tools, such as digging buckets or the like. The present attachment includes a pivot frame carried by a quick attachment frame that will latch onto a quick attachment bracket, and be locked in place. The pivot frame provides a pivotal mounting for a motor or power unit, as shown an earth auger and when mounted on the quick attachment frame permits a limited amount of pivoting about a first horizontal axis, (one degree of freedom) so that the auger axis can be permitted to seek vertical under gravity. The quick attachment frame has pivot stops to permit control so that the auger pivoting may be stopped at a desired angle relative to the vertical and can be further pivoted under power by pivoting the quick attachment bracket when the quick attachment frame is latched in place when not in use.

The pivot frame has corners which will engage stops on portions of the quick attachment frame after a desired number of degrees of pivoting, so that a positive contact is made with the quick attachment frame. The quick attachment bracket is a universal bracket pivoted to a backhoe or excavator arm and controlled for pivoting by an actuator, to in turn move the auger about the mounting axis of the quick attachment bracket after the pivot frame and driven tool (the auger) has pivoted to the stopped position.

The auger can be permitted to accommodate variations in working conditions that require limited pivoting about a first horizontal mounting axis, while taking advantage of a quick attachment bracket for connection to an implement.

The implement operator thus has the ability to control the inclination of the power unit and mounted auger about one horizontal axis when the pivot frame engages the stops. The auger can then be placed into a storage position folded underneath the arm as shown in dotted lines in FIG. 1, lowered to and rested on the ground or a support and unlatched from or latched to the quick attachment bracket.

DETAILED DESCRIPTION OF THE PREFERRED EMBODIMENTS

Figure 1:
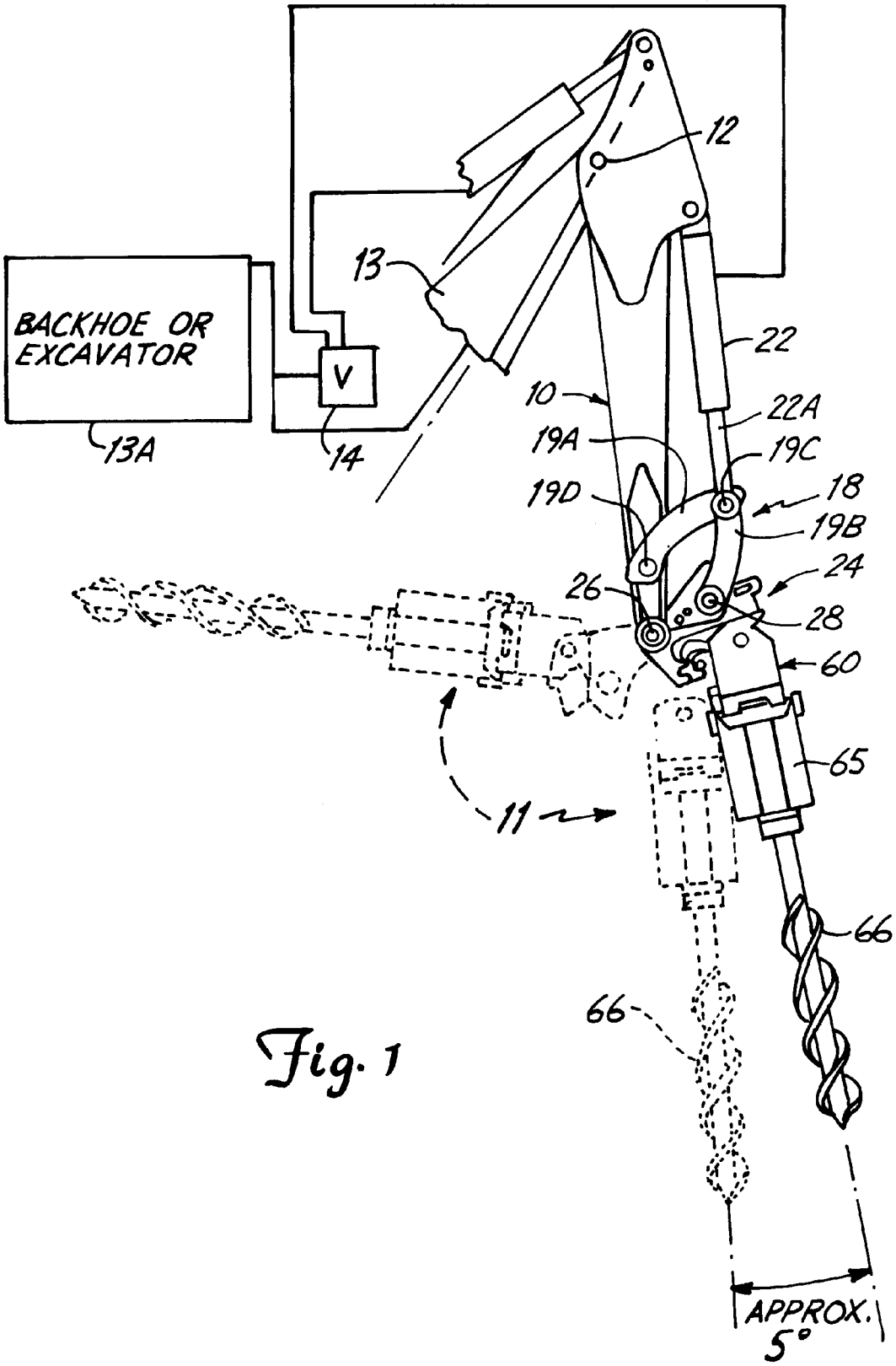
FIG. 1 is a schematic representation of a backhoe or excavator arm having a bracket made according to the present invention installed thereon and holding a schematically shown power unit and tool comprising an earth auger in position.

A powered implement arm 10 such as on an excavator or backhoe is used to mount a powered auxiliary tool, as shown an auger assembly 11. The arm 10 is pivotally mounted to a boom arm section 13 at pivot 12 (FIG. 1). The boom arm 13 is pivoted to a backhoe or excavator represented at 13A. The arm 10 is controlled and operated from the implement mounting platform, using hydraulic actuators from a source of hydraulic fluid under pressure, and operated by valve controls 14. An outer end of the arm 10 as shown mounts a link assembly 18 that is used for controlling pivoting of the tool or auger assembly 11 relative to the arm 10. The link assembly 18 is actuated with a double acting hydraulic actuator shown at 22 and operated through valve 14. The actuator 22 extends and retracts an actuator rod 22A under power and controls pivotal movement of a quick attachment mounting bracket 24 that is pivotally mounted on a pin 26 to the outer end of the arm 10. The actuator 22, acting through link assembly 18 will control pivoting of the bracket 24 about the horizontal axis of the pin 26. The hydraulic actuator can be attached directly to the bracket 24 to eliminate the link assembly 18, if desired.

The link assembly 18 as shown, has a pair of links 19A and 19B that are pivotally mounted together with a pin 19C. The pin 19C also is the attachment pin for the actuator rod 22A. The links 19A and 19B are suitably bifurcated to permit attachment on the single pin 19C. The link 19A is pivotally mounted to the arm 10 with the pin 19D and the outer end of link 19B is pivotally mounted to quick attachment bracket 24 with a pin 28.

Figure 2:
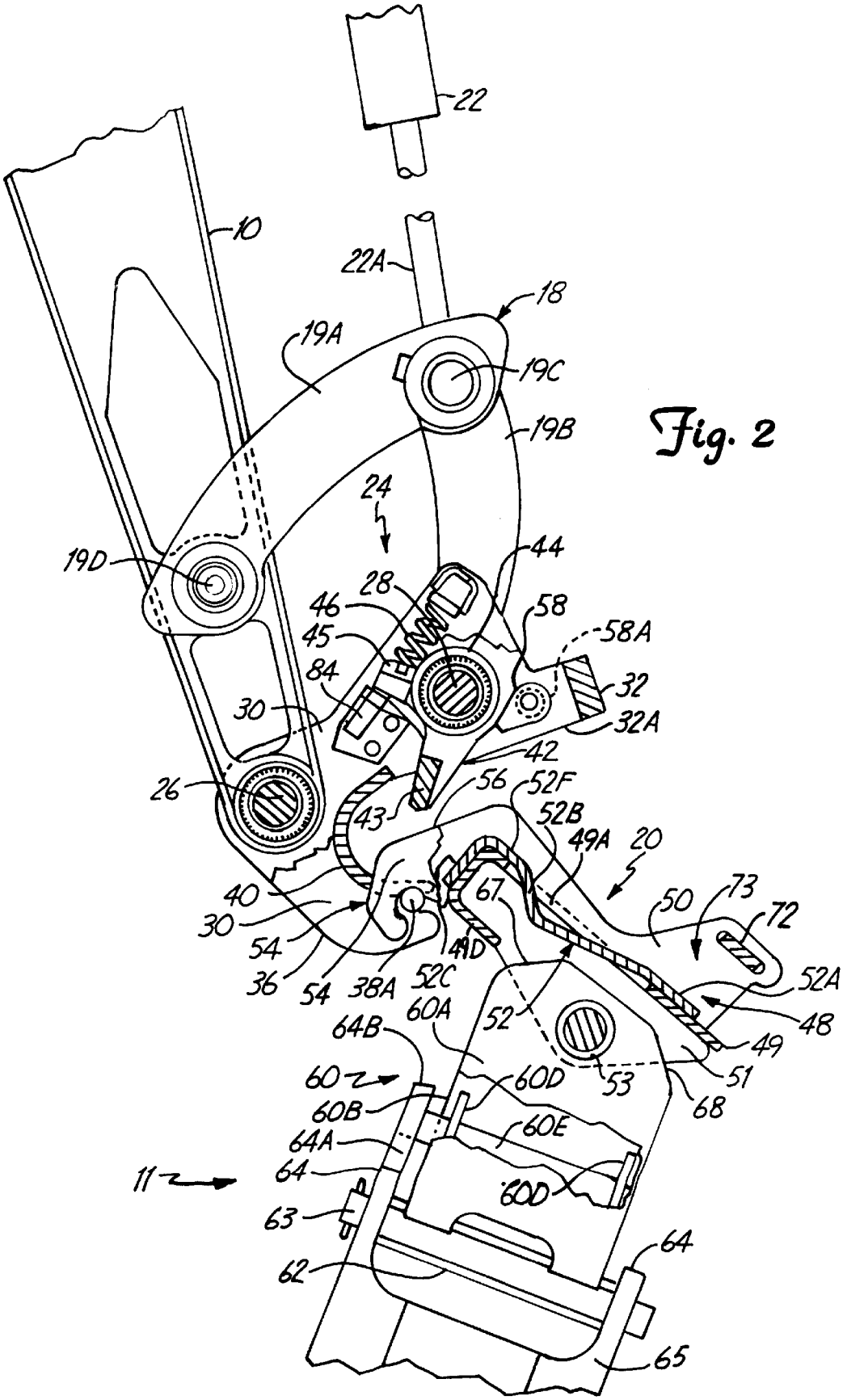
FIG. 2 is an enlarged fragmentary view with parts in section and parts broken away showing details of a quick attachment bracket and a mounting frame for the auger in a position prior to latching.
Figure 3:
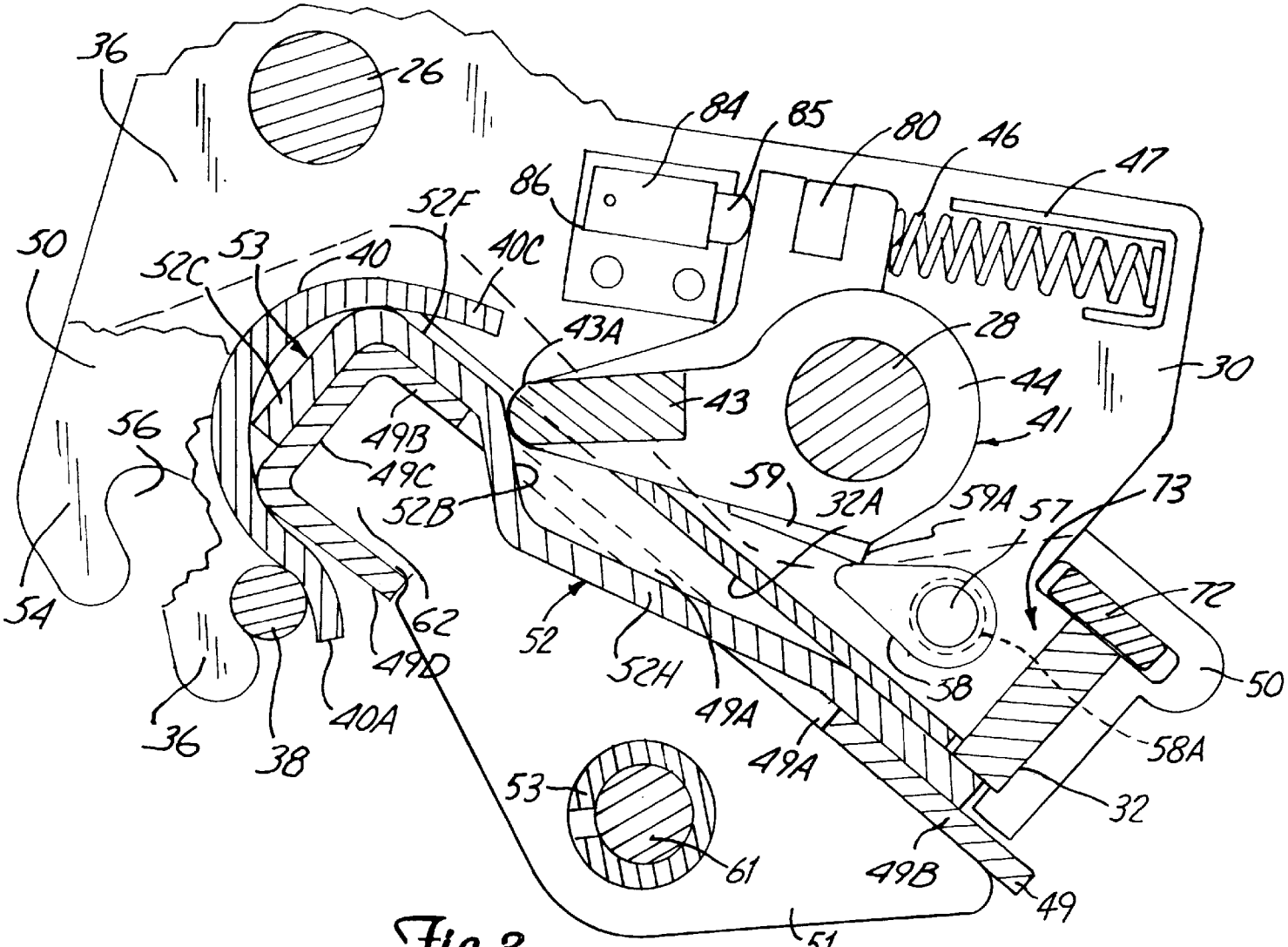
FIG. 3 is a sectional view showing a mounting frame and quick attachment bracket in a latched position.
Figure 4:
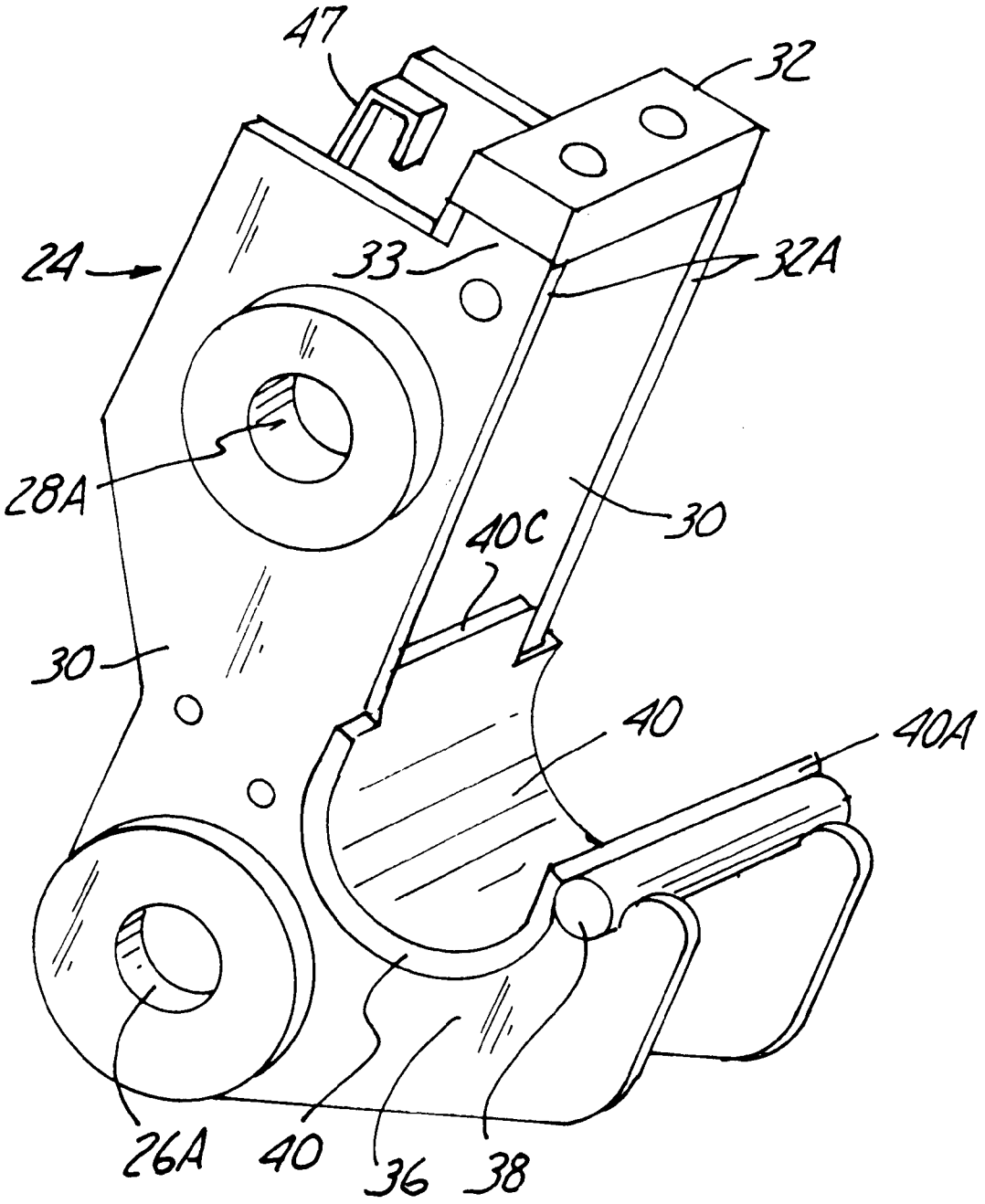
FIG. 4 is a perspective view of the mounting frame detached from its supports on a backhoe or excavator arm.
Figure 5:
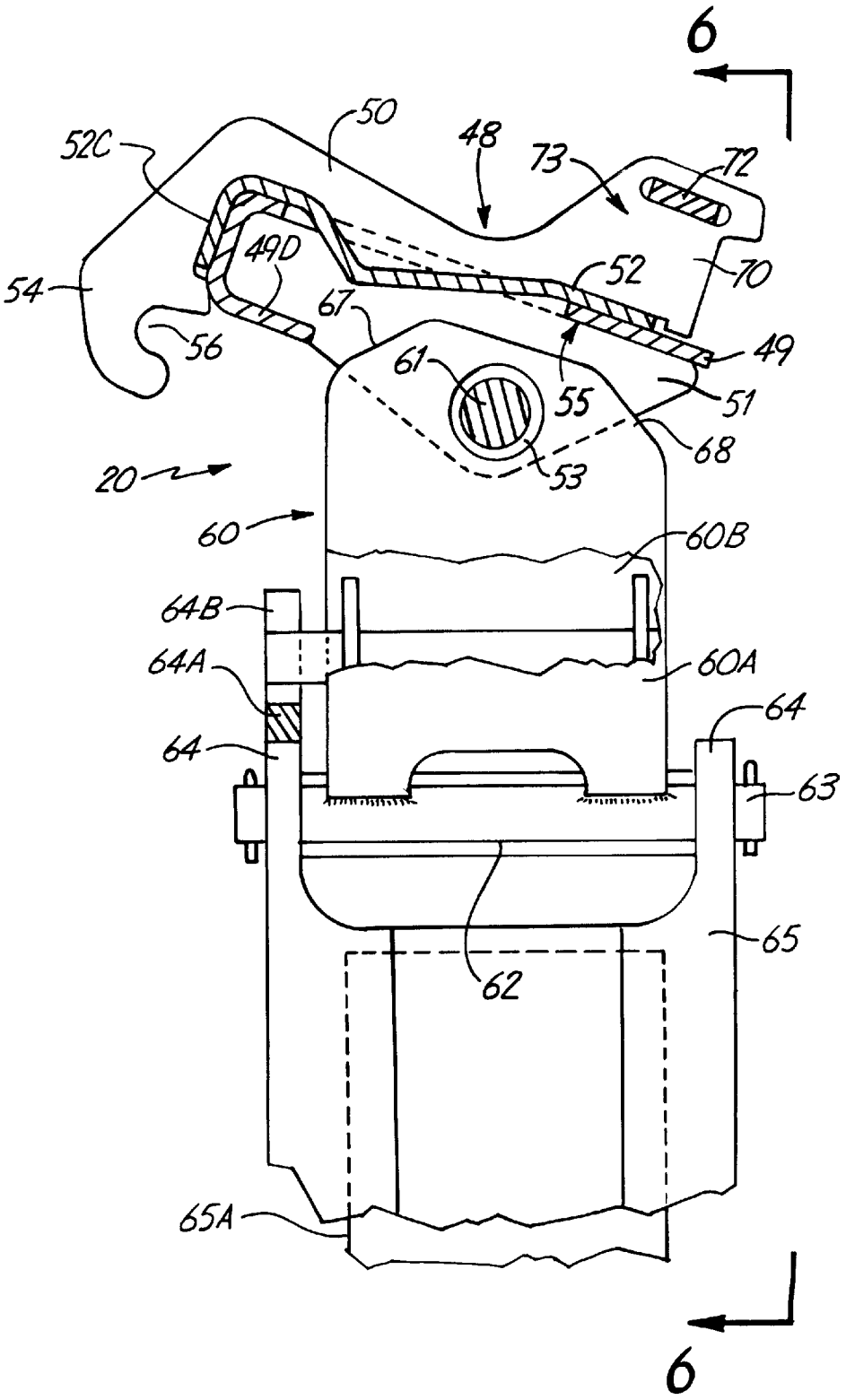
FIG. 5 is a side elevational view illustrating an attachment bracket and mounting frame for an auger with parts in section and broken away.
Figure 6:
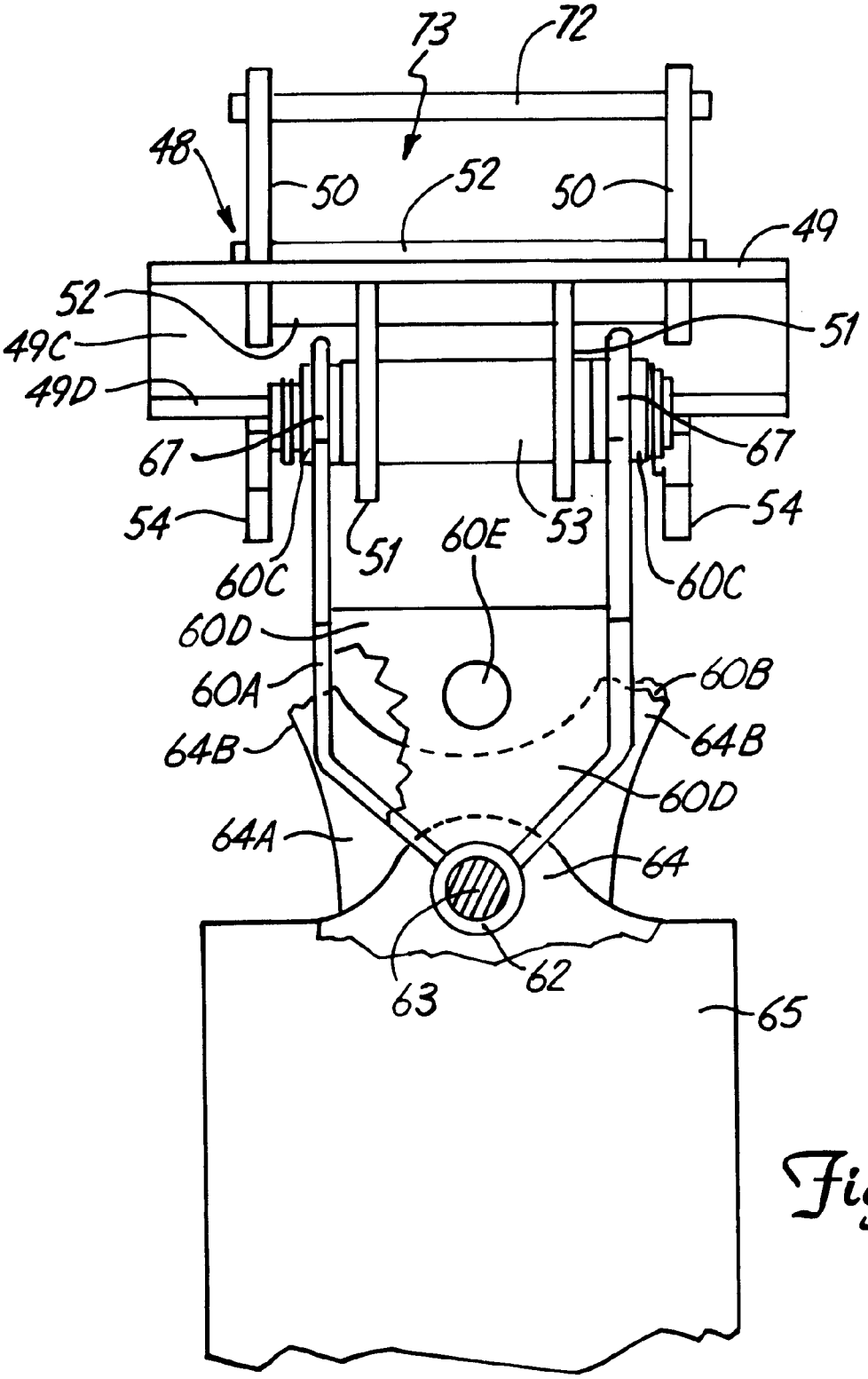
FIG. 6 is a view taken generally along line 6—6 in FIG. 5.

The quick attachment bracket 24 as seen in FIGS. 2 and 3 and 4 has a pair of side plates 30, 30 that support a formed mounting member bar on 32 that extends across the space between the side plates 30 and is welded to the side plates 30 to form a mounting member assembly. The side plates 30 are formed to have lower support ears 36 that are recessed to support a "C" shaped saddle receptacle or retainer receptacle 40 that is spaced from the mounting member also extends across the space between the side plates 30 and is welded thereto to secure the opposite ends of the quick attachment bracket 24. A tongue 40C of the saddle receptacle of retainer receptacle 40 extends between the side plates. The side plates 30 receive the main mounting pin 26 through bores 26A and the pin 26 extends across the space between the side plates 30. The linkage pin 28 also extends through bores 28A and extends across the space between the side plates 30.

A pin 38 is supported on the outer ends of the ears 36 and is held in place partially under a lead-in lip 40A on one outer edge of the "C" shaped saddle receptacle 40. The pin 38 extends outwardly beyond the side plates 30 to provide support ends 38A, which are used to support the auger assembly 11 during mounting and releasing an adapter frame 20 from the quick attachment bracket 24.

The pivot pin 28, as shown for automatic operation also mounts a frame latch 41 (FIGS. 2 and 3). The latch 41 is a yoke shaped member that has a pair of latch arms 42 held together with a latch bar 43 at their outer ends. The arms 42 have hubs 44 that also have bores that pivotally mount over the pivot pin 28. The hubs 44 have control arms 45 extending therefrom, and the arms 45 are spring loaded with strong compression springs 46 that are retained in spring supports 47 that are fixed to the side plates 30 and bear against the arms 45. The end 43A of the latch 41 is rounded with a large radius for smooth engagement when latching.

The latch 41 is thus urged by the springs 46 to rotate in counterclockwise direction as shown in FIGS. 2 and 3, and the latch 41 is retained from rotating beyond a desired position.

The adapter frame 20 includes a quick attachment frame 48 which is used to couple to quick attachment bracket 24 shown in FIGS. 1, 2, 3, 5 and 6. The frame 48 is made up of side plates 50, 50 that are welded to a latch backing plate 52 that is mounted to a cross plate 49 to make a cross plate assembly 55. The side plates 50 have hook ends 54 with receptacles 56 formed in them.

The side plates 50 of the frame 48 are spaced wider than the side plates 30, the mounting member on bar 32 and the "C" shaped saddle receptacle 40 of bracket 24. The side plates 50 thus will fit over the outside of the quick attachment bracket 24 when the bracket 24 seats in the quick attachment frame 48.

The latch 41 is held in its "ready" position shown in FIG. 2 when the quick attach bracket 24 is ready to be used in any selected way, and as shown in FIGS. 2 and 3, a pivoting pawl 58 is mounted on a shaft 57, on at least one side of the latch. The pivoting pawl 58 aligns with a hub 44 of the frame latch 41 and as shown in FIG. 3 the pawl 58 is positioned to engage a stop lug 59 integral with a hub 44. The stop lug has a stop surface 59A for holding the latch retracted when the frame is to be released. Block or actuator 84 and a surface of arm 45 are used to hold the latch in the ready position as shown in FIG. 2. The pawl 58 is spring loaded with a torsion spring 58A to rotate in clockwise direction as shown in FIG. 3. The torsion spring 58A is shown only schematically. The pawl 58 is optional, in that the latch 41 can be held by actuator 84, which will be explained subsequently. The end of the latch 41 protrudes into the area overlying the "C" shaped saddle receptacle 40 when the latch is in its ready position as shown in FIG. 2.

The plate 52 of frame 48 in the form shown, is formed to mate with and be retained by the quick attachment bracket 24 and is perhaps best understood from the showing in FIGS. 2 and 3 includes a planar flange portion 52A at one end. In the mid portions of the plate 52 it bends inwardly through an opening 49A in a plate 49 that forms part of an auger mounting adapter 20 to a secure mounting plate for spaced support plate 51 that mount a pivot hub 53 (See FIGS. 2, 3, 5 and 6)15 An inclined latch wall section 52B of plate 52 is formed to extend back outwardly through opening 49A. The plate 52 has a section 52F that is coplanar with planar flange portion 52A and the end edge of the plate 52 then has a flange 52C formed at an angle, as shown at right angles, to the plane of the planar flange portion 52A and the wall section 52F. The flange 52C forms an edge of the cross plate assembly 55, and has a rounded corner and is made to seat in the receptacle formed in the ears 54 of the side plates 50 of the quick attachment frame 48.

The plate 49 of cross plate assembly 55 is formed with an inverted channel edge portion 49B, as perhaps can be seen by referring to FIG. 3. The channel 49B is formed with a base wall 49C and a flange 49D is formed to extend back toward the opposite end of the cross plate 49. The opening 49A formed in the plate 49 permits the latch section 52B of plate 52 to extend to position to be engaged by latch 41 when the frame 48 is attached to the mounting bracket 24.

The frame 48 can also be retained in position with bolts that extend from the frame 48 to the bracket 24 to hold the frame 48 in place.

The adapter frame 20 further includes a pivot frame or hanger bracket 60 that as shown has a pair of side plates, also called hanger plates 60A and 60B that are spaced apart at one end and have pivot hubs 60C therein, which fit to the outside of the hub 53, and a pivot pin 61 is used for pivotally mounting the pivot frame or hanger bracket 60 to the attachment frame section 48. Additionally, the side or hanger plates 60A and 60B taper together at the lower end. The side or hanger plates are held with a pair of suitable spaced brace plates 60D. The lower ends of plates 60A and 60B mount a sleeve 62 which is positioned with its axis at 90° to the axis of the pivot pin 61. The sleeve 62 in turn carries a pivot pin 63 which passes through support ears 64 on a hydraulic motor or power unit frame assembly 65 that mounts a motor or power unit 65A shown schematically and forming the drive for the earth auger or for other tools. The motor frame assembly 65, as shown in FIG. 1 mounts a hydraulic motor 65A that has an output shaft that directly drives a helical auger 66, that is used for drilling into the ground. The motor 65A is a power unit and can be used for powering other accessories such as a compactor plate or the like. Also, the motor can be mounted directly to the pivot frame or hanger bracket 60, between side or hanger plates 60A and 60B.

The side plates 60A and 60B are formed relative to the surface of latch backing plate 52 that is adjacent to the plates 60A and 60B so that the pivot frame 60 can swing relative to the attachment bracket 48 for alignment purposes when initially working, but can be also controlled by an operator actuating the actuator 22. As shown, the end edges at corner portions of each of the plates 60A and 60B adjacent the side that is near the latch backing plate 52 have a trimmed surface 67 that is formed to be at a selected angle relative to the plane of the bent out portion 52H of backing plate 52 so it will stop against the portion 52H of backing plate 52 which is part of the cross plate assembly 55, when the bracket 48 is rotated counter clockwise in FIGS. 2 and 5 a selected amount with the attachment frame latched to quick attach bracket 24. It should be noted that in FIG. 2 the attachment frame 48 is shown in the progress of being attached to bracket 24. The end edges of plates 60A and 60B on an opposite side from edge 67 are formed as shown at 68. The end edges 67 and 68 are formed by trimming corner portions of the sides of the hanger plates at angles selected so that the pivot frame 60 will be stopped on the desired position in the opposite direction of pivoting against the planar part of the cross plate 49, which is part of cross plate assembly 55 with plate 52. The stop action is against either plate 52 or cross plate 49 of the cross plate assembly 55, which can be considered a single cross plate for this purpose. If the latch portion 52H is not used, edge 67 can be stopped on part of cross plate 49.

The portion of the side or hanger plates 60A and 60B between the end edges 67 and 68 is trimmed away so that the auger pivot frame can pivot on the pin 53 a selected number of degrees in either direction of pivoting. As shown in FIG. 1, the pivoting in counter clockwise direction relative to the quick attachment frame with the bracket 24 positioned as shown will be about 110°, and when the actuator 22 is fully retracted, the axis of the auger will be approximately 5° from vertical in a counter clockwise direction.

To fold the auger assembly underneath the boom, the actuator 22 is fully extended, to move the auger assembly to position also shown in dotted lines in FIG. 1, but it also shows that the auger or other tool then can be above a horizontal plane.

In the working position, in between the extremes, the auger or tool will float or be free to pivot about the pivot frame mounting axis and will seek a vertical position, as a pendulum. The pivoting can continue until one of the stop edges 67 and 68 engage the aligned stop formed by the plates 49 and 52.

The auger can pivot from side to side about the axis of the pin 63, as permitted by a stop bracket 64A mounted on one of the ears 64. The stop bracket has ears 64B that will engage an end of a pin 60E held in brace plates 60D to limit the pivoting of the auger. The stops formed by the quick attach frame plate section 52A cooperating with the pivot bracket 60 permit the operator to control positioning of the auger while permitting the auger to be aligned under gravity.

The quick attachment frame 48 can easily be installed on the quick attachment bracket 24 on the arm 10 using a procedure shown schematically in FIGS. 2 and 3. When the auger is to be attached to the arm 10, the receptacles 56 of side plates 50 are hooked onto the ends 38A of the rod 38, with the auger in an appropriate stored position. The auger or tool can be stored either to be in a substantially horizontal position, or supported in a vertical rack. Moving the arm 10 to the desired location and extending the actuator 22 will roll the quick attachment bracket 24 so that the mounting member on nose bar 32 fits between the side plates 50, 50 and edges 32A can be rested against the plate portion 52A, both of which positions are shown in FIG. 2. The flange 52C and the channel member 49B can then be slipped into the "C" shaped saddle receptacle 40 by moving the arm 10 about pivot 12.

The side plates 50 have ears 70 that protrude from the plate 52, and are spaced apart. These ears 70 have slots that receive a cross retainer bar 72, that is thus spaced from the parallel plate portion 52A to form a receiver or slot 73 for the mounting member on nose bar 32. Upon sliding the quick attachment bracket 24 into position, the nose bar 32 will pass between the bar 72 and the plate portion 52A as the channel section and flange 52C seat in the saddle receptacle 40 on the quick attachment bracket. The latch 41, and in particular the nose portions 42 and the cross member 43, will slide out of the way as the quick attachment frame 48 is pushed into position. The latch 41 will spring back to cause the end 43A to rest against the inclined latch section 52B of plate 52 and hold the quick attachment frame 48 securely on the quick attachment bracket 24, to latch the entire auger adapter 20 in place. Again, the nose bar 32 can be attached to a cross member supported on ears 70 with bolts if the automatic latch is not used.

The latch 41 can be released for disconnecting frame 48 by actuating suitable actuators 84 that are mounted on brackets 86 on the side plates 30. The actuators 84 have rods 85 that act on the arms 45 and retract the latch 41 to clear the plate 52 and permit the quick attachment frame 48 to be released from the quick attachment bracket 24. Stop dog 58 will seat on the surface 59A to hold the latch 41 in its released position after the quick attachment frame 48 has been removed. The latch dog 58 is spring loaded with a torsion spring toward the surface 59A. A pry bar or lever can be used in recess 80 for unlatching the latch 44, for manual operation.

The earth auger 11 or other tool thus can be quickly attached to a backhoe or excavator arm, and can be provided with the freedom about one axis to swing relative to the adapter bracket that has stop surfaces for limiting the amount of swing but permitting sufficient swing for operation. The hydraulic motor 65A supported on frame assembly 65 for the auger is powered in the normal manner from the power unit for the backhoe or excavator. Other tools can be attached to the motor and will have the freedom to pivot about the axis of pivot pin 61 until it strikes the stop edges.

Although the present invention has been described with reference to preferred embodiments, workers skilled in the art will recognize that changes may be made in form and detail without departing from the spirit and scope of the invention.

What is claimed is:

1. A mounting device for mounting a powered attachment tool which is elongated along a working axis to a quick attachment bracket that is pivotally mounted on a prime mover, the quick attachment bracket comprising a saddle receptacle, and a mounting member spaced from the receptacle, the mounting device comprising an adapter frame, including a plate assembly having an edge portion for mating with the receptacle on the quick attachment bracket and a retainer spaced from the edge portion for retaining a mounting member of the quick attachment bracket, at least one support plate mounted on said adapter frame, a hub supported on the at least one support plate and having a hub axis parallel to a pivotal axis of the quick attachment bracket on which the adapter frame is placed, a hanger bracket for the powered attachment tool elongated along a working axis and pivotally mounted on said hub, said hanger bracket having end edges adjacent portions of said adapter frame formed to provide for a limited amount of pivoting of the hanger bracket relative to the adapter frame to permit the elongated tool to seek a vertical position under gravity when supported by the hanger bracket before an end edge engages the adapter frame.

2. The device of claim 1, wherein said adapter frame plate assembly comprises a cross plate, at least one of said hanger bracket end edges engaging the cross plate in one direction of pivoting of the hanger bracket.

3. The device of claim 2, wherein a second edge of the hanger bracket on an opposite side of the hub from the at least one edge engages and stops against the adapter frame plate assembly in a second direction of pivoting.

4. The device of claim 1, wherein said hanger bracket has a second hub mounted thereon with a second hub axis perpendicular to the hub axis of the hub supported on the at least one support plate, said second hub pivotally mounting the powered attachment tool such that the powered attachment tool can pivot relative to the adapter frame about two substantially mutually perpendicular axes to seek the vertical portion under gravity.

5. The device of claim 4, wherein the hanger bracket comprises first and second hanger plates on opposite ends of the hub supported on the at least one support plate, the second hub being supported by both of said hanger plates.

6. The device of claim 1, wherein said quick attachment bracket is pivotally mounted to a support arm of a prime mover, said device comprising a hydraulic actuator for pivotally moving said quick attachment bracket, said hydraulic actuator having a range of linear movement, said quick attachment bracket being pivotable more than 90° by moving the hydraulic actuator through a range of movement.

7. The device of claim 1, wherein the hanger bracket has end edges adjacent the adapter frame when supported on the hub, the end edges being trimmed at selected angles to provide clearance for permitting the limited amount of pivoting.

8. The device of claim 1, wherein the cross plate assembly extends between the edge portion and the retainer, the at least one support plate being fixedly mounted on the cross plate assembly, and wherein the hanger bracket comprises a pair of spaced apart hanger plates, the hub extending between the hanger plates at first ends thereof, the hanger plates having planes parallel to the at least one support plate, the hanger plates having edges at the first ends thereof including edge portions trimmed to provide stop surfaces engaging portions of the cross plate assembly at selected positions of pivoting of the hanger bracket.

9. A mounting device for mounting a powered tool that has an axis oriented vertically under gravity in a working position to a quick attachment bracket that is pivotally mounted on a prime mover, the quick attachment bracket comprising a saddle, and a mounting member spaced from the saddle receptacle, the mounting device comprising an adapter frame, including an assembly having a pair of side plates and a cross plate between the side plates, an edge of the cross plate mating with the saddle receptacle on the quick attachment bracket, and a receiver space between the side plates for receiving and retaining the mounting member of the quick attachment bracket, at a location spaced from the edge saddle receptacle when the adapter frame is positioned on the quick attachment bracket, a hub supported on the adapter frame and extending in a direction between the side plates at a position spaced from the cross plate and from the edge of the cross plate, the hub having an axis substantially parallel to the cross plate, a hanger bracket for a powered tool pivotally mounted on said hub between planes of the side plates, said hanger bracket having hanger bracket plates with end edges adjacent portions of said cross plate, the end edges being formed to provide stops that stop against the cross plate to limit the pivoting of the hanger bracket relative to the adapter frame about the axis of the hub, the hanger bracket being free to pivot when the powered tool is supported thereby to permit the axis of the powered tool to seek a vertical position under gravity.

10. The mounting device of claim 9, in combination with a quick attachment bracket adapted to be pivotally mounted to a support arm of a prime mover, a hydraulic actuator for pivotally moving said quick attachment bracket, said hydraulic actuator having a range of linear movement, said quick attachment bracket being pivotable more than 90° by moving the hydraulic actuator through its range of movement.

11. The mounting device of claim 9, wherein the end edges of the hanger bracket plates are adjacent the cross plate when the hanger bracket is supported on the hub, the end edges being trimmed at selected angles on opposite sides of each hanger bracket plate.

12. The mounting device of claim 11, wherein the cross plate comprises a plate assembly including a latch plate portion formed to provide a latch surface for engaging a latch on the quick attachment bracket.

13. The mounting device of claim 9 wherein the powered tool comprises an earth auger having an elongated axis that is oriented vertically in a working position.

* * * * *

UNITED STATES PATENT AND TRADEMARK OFFICE

CERTIFICATE OF CORRECTION

PATENT NO. : 6,000,154

DATED : December 14, 1999

INVENTOR(S) : Craig A. Berard et al.

It is certified that error appears in the above-identified patent and that said Letters Patent is hereby corrected as shown below:

Under [56] References Cited
U.S. Patent Documents

Please add all of the following considered references:

| | | | |
|---|---|---|---|
| --2,526,984 | 10/1950 | Weishaar | 255/21 |
| 2,963,183 | 12/1960 | Przybylski | 214/145 |
| 2,969,844 | 1/1961 | Hamrick | 175/130 |
| 3,237,795 | 3/1966 | Kromer | 214/140 |
| 4,148,366 | 4/1979 | Beckstrom et al. | 791/917 |
| 4,199,033 | 4/1980 | Van Gundy, Jr. | 173/27 |
| 4,213,731 | 7/1980 | Verachtert | 414/723 |
| 4,214,840 | 7/1980 | Beales | 403/31 |
| 4,225,283 | 9/1980 | Baker et al. | 414/723 |
| 4,477,101 | 10/1984 | Nilsson et al. | 280/461 |
| 4,480,955 | 11/1984 | Andrews et al. | 414/723 |
| 4,632,595 | 12/1986 | Schaeff | 403/330 |
| 4,761,113 | 8/1988 | Smith et al. | 414/723 |
| 4,929,143 | 5/1990 | Dohnalik | 414/723 |
| 4,998,590 | 3/1991 | Wells | 175/162 |
| 5,024,010 | 6/1991 | Hulden | 37/468 |
| 5,082,389 | 1/1992 | Balemi | 403/322 |
| 5,098,252 | 3/1992 | Sheesley et al. | 414/723 |
| 5,107,610 | 4/1992 | Fusco | 37/103 |
| 5,110,254 | 5/1992 | Aubrey | 414/723 |
| 5,111,888 | 5/1992 | Wimmer | 173/42 |

UNITED STATES PATENT AND TRADEMARK OFFICE

CERTIFICATE OF CORRECTION

PATENT NO. : 6,000,154

DATED : December 14, 1999

INVENTOR(S) : Craig A. Berard et al.

It is certified that error appears in the above-identified patent and that said Letters Patent is hereby corrected as shown below:

| | | | |
|---|---|---|---|
| 5,145,313 | 9/1992 | Weyer | 414/723 |
| 5,147,173 | 9/1992 | Fauber et al. | 414/723 |
| 5,242,258 | 9/1993 | Weyer | 414/723 |
| 5,332,353 | 7/1994 | Arnold | 414/723 |
| 5,333,695 | 8/1994 | Walter | 172/372 |
| 5,350,250 | 9/1994 | Nagler | 403/316 |
| 5,415,235 | 5/1995 | Gebauer | 37/468 |
| 5,431,528 | 7/1995 | Jenkins et al. | 37/468 |
| 5,511,329 | 4/1996 | Mickelson | 414/723 |
| 5,515,626 | 5/1996 | Holscher | 414/723 |
| 5,556,217 | 9/1996 | Deyo et al. | 403/61 |
| 5,561,926 | 10/1996 | Stratti | 37/468 |
| 5,597,283 | 1/1997 | Jones | 37/468 |
| 5,626,457 | 5/1997 | Hickman, Jr. | 414/912 |
| 5,692,325 | 12/1997 | Kuzutani | 37/468 |
| 5,727,342 | 3/1998 | Horton | 37/468 |
| 5,850,704 | 12/1998 | Harinen | 414/723 |

FOREIGN PATENT DOCUMENTS

| | | |
|---|---|---|
| 0,321,902 | 6/1989 | Europe |
| 0,472,115 | 2/1992 | Europe |
| 0,521,560 | 1/1993 | Europe |
| 0,637,649 | 2/1995 | Europe |
| 0,672,796 | 9/1995 | Europe |
| 0,763,531 | 9/1980 | Soviet Union |
| 1,071,151 | 2/1980 | Canada |
| 2,040,262 | 8/1980 | Great Britain |

UNITED STATES PATENT AND TRADEMARK OFFICE

CERTIFICATE OF CORRECTION

PATENT NO. : 6,000,154

DATED : December 14, 1999

INVENTOR(S) : Craig A. Berard, et. al.

It is certified that error appears in the above-identified patent and that said Letters Patent is hereby corrected as shown below:

| | | |
|---|---|---|
| 2,068,332 | 8/1981 | Great Britain |
| 2,169,582 | 7/1986 | United Kingdom |
| 2,690,718 | 11/1993 | France |
| 7,904,335 | 12/1980 | Netherlands |
| 8,802,421 | 4/1998 | World |
| 9,000,721 | 3/1990 | Germany |

Column 3, line 1, after "member", insert --or--.
Column 3, line 1, delete "on".

Column 3, line 47, delete "on", insert --or--.

Column 4, line 10, delete "plate", insert --plates--.

Column 5, line 56, delete "on", insert --or--.

Column 5, line 66, delete "on", insert --or--.

Signed and Sealed this

Sixth Day of February, 2001

*Attest:*

*Attesting Officer*

Q. TODD DICKINSON

*Director of Patents and Trademarks*